US008142578B2

(12) United States Patent
Cantrel et al.

(10) Patent No.: US 8,142,578 B2
(45) Date of Patent: Mar. 27, 2012

(54) PROCESS FOR MANUFACTURING HOT-FORGED PARTS MADE OF A MAGNESIUM ALLOY

(75) Inventors: Pascal Cantrel, Bar sur Aube (FR); Sophie Lubin, Herblay (FR); Christian Henri Paul Mauhe, Houilles (FR); Isabelle Robert, Conflans Sainte Honorine (FR); Jean Stracchi, Bar sur Aube (FR)

(73) Assignees: Hispano Suiza, Colombes (FR); Manoir Industries, Paris (FR)

( * ) Notice: Subject to any disclaimer, the term of this patent is extended or adjusted under 35 U.S.C. 154(b) by 224 days.

(21) Appl. No.: 12/374,548

(22) PCT Filed: Jul. 19, 2007

(86) PCT No.: PCT/FR2007/001245

§ 371 (c)(1), (2), (4) Date: May 18, 2009

(87) PCT Pub. No.: WO2008/009825

PCT Pub. Date: Jan. 24, 2008

(65) Prior Publication Data

US 2010/0012234 A1 Jan. 21, 2010

(30) Foreign Application Priority Data

Jul. 20, 2006 (FR) ..... 06 53053

(51) Int. Cl.
*C22F 1/06* (2006.01)

(52) U.S. Cl. ..... 148/667; 72/360

(58) Field of Classification Search ..... 148/667; 72/360

See application file for complete search history.

(56) References Cited

U.S. PATENT DOCUMENTS

| | | | | |
|---|---|---|---|---|
| 3,092,492 | A | 6/1963 | Foerster | |
| 3,157,496 | A | 11/1964 | Foerster | |
| 4,116,731 | A | 9/1978 | Tikhova et al. | |
| 6,193,817 | B1 | 2/2001 | King et al. | |
| 6,511,560 | B2 * | 1/2003 | Seki et al. | 148/667 |
| 2003/0000608 | A1 | 1/2003 | Horie et al. | |
| 2003/0129074 | A1 | 7/2003 | Bronfin et al. | |
| 2005/0002821 | A1 | 1/2005 | Bettles et al. | |
| 2006/0065332 | A1 | 3/2006 | Ienaga et al. | |
| 2006/0228249 | A1 * | 10/2006 | Lyon et al. | 420/406 |
| 2007/0102072 | A1 | 5/2007 | Kawamura et al. | |

(Continued)

FOREIGN PATENT DOCUMENTS

EP 1 329 530 7/2003

(Continued)

*Primary Examiner* — Jie Yang
(74) *Attorney, Agent, or Firm* — Oblon, Spivak, McClelland, Maier & Neustadt, L.L.P.

(57) ABSTRACT

A process for manufacturing a process for manufacturing a part made of a magnesium alloy is disclosed. The process includes a step of forging a block of the alloy followed by a heat treatment. The alloy is a casting alloy based on 85% magnesium, and containing, by weight:

Figure 1:
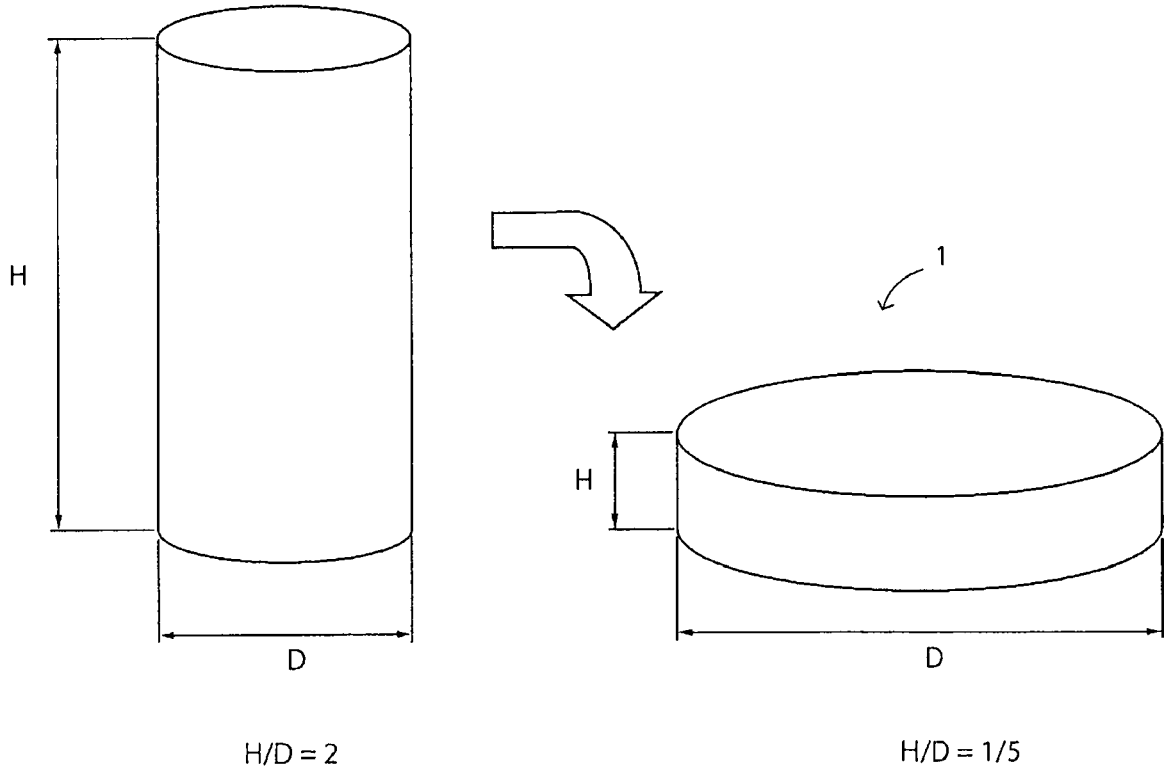

0.2 to 1.3% zinc;
2 to 4.5% neodymium;
0.2 to 7.0% rare-earth metal with an atomic number from 62 to 71;
0.2 to 1% zirconium.

The forging is carried out at a temperature above 400° C. In particular the temperature is set between 420 and 430° C. and the forging step comprises a plastic deformation carried out at a slow rate. The process allows one to produce parts such as elements of casing for aeronautical machines, operating at a temperature of around 200° C. and having good aging properties.

12 Claims, 1 Drawing Sheet

U.S. PATENT DOCUMENTS

| | | | |
|---|---|---|---|
| 2007/0125464 | A1 | 6/2007 | Kawamura et al. |

FOREIGN PATENT DOCUMENTS

| | | |
|---|---|---|
| EP | 1 640 466 | 3/2006 |
| EP | 1 690 954 | 8/2006 |
| GB | 1 023 128 | 3/1966 |
| WO | 96 24701 | 8/1996 |
| WO | 2004 001087 | 12/2003 |
| WO | 2005 035811 | 4/2005 |
| WO | 2005 052204 | 6/2005 |

* cited by examiner

PROCESS FOR MANUFACTURING HOT-FORGED PARTS MADE OF A MAGNESIUM ALLOY

The present invention relates to the field of metalworking and more particularly to the working of magnesium alloys.

In order to produce certain high-performance machine parts, it is common practice to use aluminum or else an aluminum alloy for their mechanical properties combined with low weight. For these reasons, they are used especially in automobiles and in aeronautical machines. Conventionally, the parts, such as engine casing components, are machined from plates or blanks obtained by the casting technique. However, when dealing with parts exposed in operation to temperatures ranging above 150-180° C., the thermal stability of these materials becomes insufficient. This weakness is manifested in service by distortion and loss of mechanical strength. Increasing their weight is not a solution in a field where the weight is an important factor in the choice of material.

It has been proposed to replace this metal with magnesium-based alloys for the same applications. This is because such alloys are known on the one hand for their lower density and on the other hand because they are capable of benefiting from better heat-resistance. However, not all magnesium alloys are satisfactory. For example, known alloys of the AZ31, AZ61 or AZ80 and ZK series behave similarly to aluminum alloys and thus do not meet the expressed requirement. In recent years, new cast magnesium alloys have appeared and are intended for the same field of application, but casting causes high levels of defects, of around 15 to 30%. The defects, such as porosity or shrink marks, have to be taken into account when designing parts. This reduces the benefit of their use.

Moreover, to the knowledge of the applicant, there is only one industrial forged magnesium alloy that has sufficiently stable characteristics within the field of use at a temperature above 180° C., the WE 43, but it is very expensive.

However, according to the prior art, it is accepted that the tensile strength and yield strength of a block of magnesium alloy are negatively influenced by the temperature at which the deformation is carried out. FIG. 6.64 of the work "magnesium technology" of 2006 by Horst E. Friedrich and Barry L. Mordike, published by Springer Germany, thus shows that an ingot of QE22 alloy (Mg; 2.2% Ag; 2% Nd; 0.5% Zr) subjected to an extrusion treatment experiences a drop in its mechanical properties when the temperature at which the ingot is made is increased. The temperature explored was limited to 400° C.

The applicant set itself the objective of producing a part made of a magnesium alloy, for the reduction in weight that it provides, in particular compared with aluminum, but the metallurgical and dimensional stability at the operating temperatures of said part being sufficient not to require the mechanically stressed zones to be thickened. As a matter of fact such a thickening often becomes necessary in order to take into account the loss of characteristics due to the thermal aging of the constituent material.

It is important for the cost to remain below that of the use of known alloys.

The invention achieves these objectives with a process for manufacturing a part made of a magnesium alloy, comprising a step of forging a block of said alloy followed by a heat treatment, characterized in that the alloy is a casting alloy based on 85% magnesium, and containing, by weight:

0.2 to 1.3% zinc;

2 to 4.5% neodymium;

0.2 to 7.0% rare-earth metal with an atomic number from 62 to 71;

0.2 to 1.0% zirconium, and in that the forging is carried out at a temperature above 400° C.

One example of a casting alloy is that supplied by the company Magnesium Elektron Limited (under the reference Elektron 21) with the standardized name EV31A, and the more precise composition of which is as follows. The magnesium alloy contains: 0.2 to 0.5% zinc, 2.6 to 3.1% neodymium, 1.0 to 1.7% gadolinium, and is saturated with zirconium. This product is defined by the claims of patent application WO 2005/035811.

More particularly, the forging temperature is between 420° C. and 430° C. and the plastic deformation is carried out at a slow rate, especially at a rate, corresponding to the rate of movement of the forging slide, of less than 40 mm/s.

Whereas according to the prior art, as illustrated in the abovementioned work, hot forging of a magnesium casting alloy does not appear to give good results as regards its mechanical properties, it has been found surprisingly that applying the process of the invention to a casting alloy of the EV31A family, which already provides high mechanical properties and improved corrosion resistance, makes it possible to produce parts that furthermore exhibit excellent aging resistance, while being in service subjected to temperatures of around 200° C. Furthermore, by forging the level of defects is substantially reduced.

Preferably and in accordance with one embodiment, the forging plastic deformation is carried out by closed-die forging in one or more steps.

In accordance with another embodiment, the plastic deformation is carried out by extrusion or rolling.

In accordance with another feature, the initial block is cast and more particularly the cast block is pre-wrought before closed-die forging.

In accordance with another feature, the forging is followed by a heat treatment with a solution heat treatment step, a quenching step and a tempering step at a temperature between 200° C. and 250° C.

Figure 2:
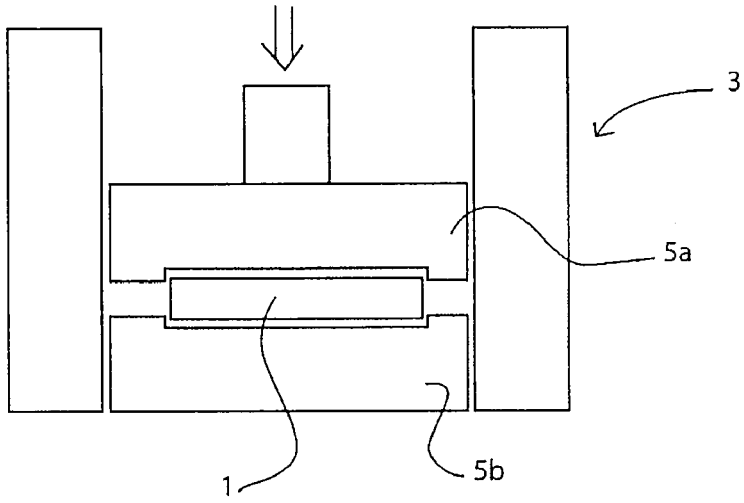

One embodiment of the invention will now be described by way of a nonlimiting example, with reference to the appended drawings in which:

FIG. 1 shows a casting alloy block in its initial form before forging and in its form after being wrought; and FIG. 2 is an example of a closed-die forging installation.

A cast block of EV31A alloy is firstly treated. A slug, with an initial slenderness (H/D ratio) of around 2, was wrought several times in order to obtain a disk 1 with an H/D slenderness ratio of 1/5, for which ratio it is possible to forge said disk, without it being contained laterally, and without the risk of buckling or the creation of imperfections in the fibers of the metal. The disk is wrought here by upsetting or another technique. An upsetting device for producing wrought metal slugs comprises two flat elements, which may optionally include an insetting housing. A slug is placed on the lower element, the two flat elements being pressed against each other, by means of a press, in order to upset the slug, which here takes the form corresponding to the housing between the two flat elements. Several upsetting operations are generally needed in order to obtain the slug that can be used in closed-die forging. It is possible to reheat the slugs between the various upsetting operations.

Next, closed-die forging is undertaken in one or more steps. For example, a first step of closed-die forging of a blank enables a first shape approaching the final shape to be achieved. Next, a high-precision closed-die forging operation is carried out on a press, enabling the part to achieve its definitive shape. It should be pointed out that this definitive shape may where appropriate be machined in order to obtain the part ready to be used. An example of an installation 3 is shown in FIG. 2. The upper 5*a* and lower 5*b* dies are flat elements enabling the shape to be obtained in the step in question. Installation includes heating means, in this case a ventilated electric furnace, in order to heat the disk to the temperature in accordance with the process of the invention. This temperature is above 400° C. and preferably between 420° C. and 430° C. (target temperature=425° C.) in the case of the EV31A alloy. The blank is heated in the same way before the high-precision closed-die forging step.

The forging tools are preheated and kept at temperature during the manufacturing process.

The rate of deformation of the part corresponding to the rate of movement of the slide of the closed-die forging machine is less than 40 mm/s, preferably between 10 and 30 mm/s, the target rate being 20 mm/s.

When the part has been removed from the forging installation, it is deburred (removal of excess material useful for the manufacture of the parts) and is cleaned.

Finally, the part undergoes a heat treatment of the T6 type depending on the desired mechanical properties, especially to ensure mechanical properties and dimensional stability up to 200° C.

This treatment comprises solution heat treatment for 8 hours at 520° C.;

a quench into water+polymer at below 40° C. or into water at 60 to 80° C.; and tempering step at a temperature of between 200° C. and 250° C. for a time greater than 16 hours. This temperature is determined according to the intended operating temperature of the part.

The tempering temperature range of between 200° C. and 225° C. is optimized for obtaining better characteristics in the case of an operation at ambient temperature.

The tempering temperature range of between 225° C. and 250° C. is optimized for obtaining better characteristics in the case of an operation at a temperature above 180° C.

Tests were carried out so as to be able to compare the mechanical properties of the forged alloy with an AS7G06T1R2 cast alloy of the prior art, which is a reference alloy in the aeronautical industry.

The tensile strength $R_m$ in MPa and the yield strength $R_{p0.2}$ were measured.

Without aging

| Room-temperature test | $R_m$ (MPa) | $R_{p0.2}$ (MPa) |
|---|---|---|
| AS7G06T1R2 | ≧270 | ≧220 |
| Forged EV31A | 287 | 187.5 |

After 10 000 h of aging at 180° C.

| Drop in property | $R_m$ (MPa) | $R_{p0.2}$ (MPa) |
|---|---|---|
| AS7G06T1R2 | 53% | 68% |
| Forged EV31A | 15% | <15% |

These tables show a significant improvement in the mechanical properties of the forged alloy of the invention compared with a magnesium casting alloy of the prior art, especially with regard to the properties after 10 000 hours of aging at 180° C.

The invention claimed is:

1. A process for manufacturing a part made of a magnesium alloy, comprising:

forging a block of the magnesium alloy in a closed die; and heat treating the forged block, wherein the alloy is a casting alloy, comprising, by weight:

85% magnesium;

0.2 to 1.3% zinc;

2 to 4.5% neodymium;

0.2 to 7.0% rare-earth metal with an atomic number from 62 to 71; and 0.2 to 1% zirconium, wherein the forging comprises a plastic deformation obtained by conducting the forging at a temperature above 400° C., and at a forging rate which is less than 40 mm/s, which is a rate of displacement of a forging slide of the closed die, and wherein yield strength of the part is reduced by less than 15% after 10,000 hours of aging at 180° C.

2. The process as claimed in claim 1, wherein the temperature of the forging is between 420 and 430° C.

3. The process as claimed in claim 1, wherein the rate of displacement of the forging slide is between 10 and 30 mm/s.

4. The process as claimed in claim 3, wherein the rate of displacement is 20 mm/s.

5. The process as claimed in claim 1, wherein the block of the magnesium alloy is a cast block.

6. The process as claimed in claim 5, wherein the cast block is pre-wrought prior to forging.

7. The process as claimed in claim 1, wherein the heat treating comprises:

solution heat treating, quenching, and tempering at a temperature between 200° C. and 250° C.

8. The process as claimed in claim 7, wherein the tempering temperature is between 200° C. and 225° C.

9. The process as claimed in claim 7, wherein the tempering temperature is between 225° C. and 250° C.

10. The process as claimed in claim 1, wherein the zinc content is 0.2 to 0.5%, the neodymium content is 2.6 to 3.1%, and the gadolinium content is 1.0 to 1.7%.

11. The process as claimed in claim 1, wherein a tensile strength of the obtained part is reduced by about 15% after 10,000 hours of aging at 180° C.

12. The process as claimed in claim 7, wherein the tempering is conducted for a time greater than 16 hours.

* * * * *